US009269197B2

(12) United States Patent
Van Haperen et al.

(10) Patent No.: US 9,269,197 B2
(45) Date of Patent: Feb. 23, 2016

(54) METHOD AND DEVICE FOR GENERATING TOLL INFORMATION IN A ROAD-TOLL SYSTEM

(75) Inventors: Peter Van Haperen, Burgstetten (DE); Jan Kersten, Oppenweiler (DE); Jasja Tijink, Perchtoldsdorf (AT)

(73) Assignee: Kapsch TrafficCom AG, Vienna (AT)

( * ) Notice: Subject to any disclaimer, the term of this patent is extended or adjusted under 35 U.S.C. 154(b) by 521 days.

(21) Appl. No.: 12/900,928

(22) Filed: Oct. 8, 2010

(65) Prior Publication Data

US 2011/0125558 A1 May 26, 2011

(30) Foreign Application Priority Data

Nov. 23, 2009 (EP) ..... 09450219

(51) Int. Cl.
*G07B 15/00* (2011.01)
*G07B 15/02* (2011.01)
*G07B 15/06* (2011.01)

(52) U.S. Cl.
CPC ..... *G07B 15/063* (2013.01)

(58) Field of Classification Search
USPC ..... 705/13; 340/928; 455/456.1
See application file for complete search history.

(56) References Cited

U.S. PATENT DOCUMENTS 5,289,184 A * 2/1994 Suzuki ..... 340/905
5,297,049 A * 3/1994 Gurmu et al. ..... 701/117
5,363,306 A * 11/1994 Kuwahara et al. ..... 701/461
5,508,917 A * 4/1996 Siegle et al. ..... 701/428
5,694,322 A * 12/1997 Westerlage et al. ..... 705/417
5,864,831 A * 1/1999 Schuessler ..... 705/417
5,999,126 A * 12/1999 Ito ..... 342/357.25
6,111,539 A * 8/2000 Mannings et al. ..... 342/357.31
6,546,334 B1 * 4/2003 Fukuchi ..... G01C 21/26 342/357.13
6,691,128 B2 * 2/2004 Natesan et al. ..... 701/430

(Continued)

FOREIGN PATENT DOCUMENTS

DE 101 04 499 A1 8/2002
EP 0 317 181 A2 5/1989

(Continued)

OTHER PUBLICATIONS

Extended European Search Report for corresponding European Application No. 09450219.2, dated Apr. 21, 2010, 9pp.

(Continued)

*Primary Examiner* — Brian Epstein
(74) *Attorney, Agent, or Firm* — Fiala & Weaver P.L.L.C.

(57) ABSTRACT

A method for generating toll information for vehicle devices in a road-toll system with a toll center and geographically distributed radio beacons. The method includes providing a set of location data of toll-requiring geo-objects from the respective local environment of a beacon in this beacon, recording a sequence of position data of a vehicle device in this vehicle device, if the aforementioned vehicle device is in the transmitting/receiving range of a beacon: receiving the location-data set from this beacon in the vehicle device, comparing the position-data sequence with the received location-data set in the vehicle device in order to generate toll information therefrom, and if the above-mentioned vehicle device is in the transmitting/receiving range of a beacon: transmitting the toll information from the vehicle device via the beacon to the toll center. The invention further relates to a vehicle device, a beacon and a monitoring device for such a road-toll system.

11 Claims, 3 Drawing Sheets

(56) References Cited

U.S. PATENT DOCUMENTS

| | | | | |
|---|---|---|---|---|
| 6,904,358 | B2 * | 6/2005 | Nohara et al. | 701/454 |
| 2001/0025251 | A1 * | 9/2001 | Konishi et al. | 705/13 |
| 2003/0011494 | A1 * | 1/2003 | Reider et al. | 340/993 |
| 2003/0189498 | A1 * | 10/2003 | Kakihara et al. | 340/928 |
| 2003/0236818 | A1 * | 12/2003 | Bruner et al. | 709/200 |
| 2005/0097018 | A1 * | 5/2005 | Takida | 705/35 |
| 2005/0278214 | A1 * | 12/2005 | Takida | 705/13 |
| 2006/0079248 | A1 * | 4/2006 | Otsuka et al. | 455/456.1 |
| 2006/0167628 | A1 * | 7/2006 | Karaoguz et al. | 701/211 |
| 2006/0200379 | A1 * | 9/2006 | Biet | 705/13 |
| 2006/0258367 | A1 * | 11/2006 | Chiang | 455/456.1 |
| 2007/0013526 | A1 * | 1/2007 | Kazdin et al. | 340/573.4 |
| 2007/0275731 | A1 * | 11/2007 | Alfert et al. | 455/456.1 |
| 2008/0004798 | A1 | 1/2008 | Troxler et al. | |
| 2008/0040029 | A1 * | 2/2008 | Breed | B60N 2/2863 701/514 |
| 2008/0150786 | A1 * | 6/2008 | Breed | 342/53 |
| 2008/0280624 | A1 * | 11/2008 | Wrappe | 455/456.1 |
| 2009/0024458 | A1 * | 1/2009 | Palmer | 705/13 |
| 2009/0030607 | A1 * | 1/2009 | Sakata et al. | 701/209 |
| 2009/0182496 | A1 * | 7/2009 | Tanabe | G01C 21/32 701/532 |
| 2010/0076682 | A1 * | 3/2010 | Yamada | 701/300 |
| 2010/0287038 | A1 * | 11/2010 | Copejans | 705/13 |
| 2010/0312465 | A1 * | 12/2010 | Tu | 701/201 |
| 2010/0328147 | A1 * | 12/2010 | Daems et al. | 342/357.25 |

FOREIGN PATENT DOCUMENTS

| | | | | |
|---|---|---|---|---|
| EP | 0 561 818 | B1 | 9/1993 | |
| EP | 0 697 580 | A1 | 2/1996 | |
| EP | 0 802 509 | A2 | 10/1997 | |
| EP | 0865004 | * | 9/1998 | G07B 15/00 |
| EP | 1 446 678 | B1 | 8/2004 | |
| EP | 1 909 231 | A1 | 4/2008 | |
| WO | WO 92/10824 | | 6/1992 | |
| WO | WO 2004/025574 | A1 | 3/2004 | |

OTHER PUBLICATIONS

Opposition issued in corresponding European Patent Application No. 09 450 219.2, dated Nov. 22, 2012, 25pp.

Quddus, Mohammed A. et al.; "Current map-matching algorithms for transport applications: State-of-the art and future research directions"; Transportation Research Part C 15; 2007; pp. 312-328.

Wikipedia; "Base transceiver station"; printed Nov. 11, 21, 2012 in German language; including English language Wikipedia printout; 4pp.

Appeal filed by third party in European Appl. No. 09450219.2, dated Jan. 3, 2013, 27 pages.

* cited by examiner

METHOD AND DEVICE FOR GENERATING TOLL INFORMATION IN A ROAD-TOLL SYSTEM

CROSS-REFERENCE TO RELATED APPLICATION(S)

This application claims priority to European Patent Application No. 09 450 219.2, filed on Nov. 23, 2009, the contents of which are hereby expressly incorporated by reference.

FIELD OF THE INVENTION

The present invention relates to a method for generating toll information from the movements of vehicle devices in a road-toll system that comprises at least one toll center and a plurality of connected geographically distributed beacons for short-range radio communication with the vehicle devices.

The invention further relates to a vehicle device (onboard unit, OBU) for such a road-toll system with a satellite-navigation receiver for generating a sequence of position data, a first memory for recording the position-data sequence, as well as a short-range transceiver for radio communication with one of many geographically distributed beacons when the vehicle device is located in the transmitting/receiving range of these beacons.

Finally, the invention also relates to a beacon and to a monitoring device for such a road-toll system.

BACKGROUND

"Short-range" radio communication is understood in the present description to mean radio distances (cell radii) of up to several kilometers In their functions, role distributions and interfaces, modern road-toll systems follow the principles defined in ISO Standard 17573, "Road Transport and Traffic Telematics—Electronic Fee Collection—System Architecture for Vehicle Related Transport Services." According to the latter there are essentially two basic types of systems.

"infrastructure-bound" systems, e.g., DSRC (dedicated short-range communication) toll systems, in which roadside infrastructure (roadside equipment, RSE), e.g., DSRC radio beacons, locates and charges tolls to the OBUs; and "infrastructure-less" systems such as GNSS (global navigation satellite systems) toll systems, in which the OBUs autonomously locate themselves and transmit either "raw" position data (as so-called "thin clients"), or "finished" toll information calculated from the position data and toll maps (as so-called "thick clients") to the toll center via a mobile-radio network (cellular network, CN).

Infrastructure-bound toll systems achieve a high degree of toll-charging security, but require extensive roadside infrastructure for this, in order to be able to locate OBUs over a large area, because the positional resolution of the location-finding is given from the size of the transmitting/receiving ranges and the number of beacons. Infrastructure-less toll systems, on the other hand, have basically unlimited coverage due to the self-locating-finding ability of the OBUs, but require enormous computational power (server farm) in the toll center for "thin client" systems in order to generate toll information from the raw position data of the OBUs, or in the case of "thick client systems," require correspondingly expensive OBUs which can record and process all the toll maps of the toll coverage area, and this also presumes a correspondingly expensive distribution and updating of the toll maps via the mobile-radio network. This data traffic consumes bandwidth and, not least important, is expensive for the user.

SUMMARY

The invention is directed to methods and devices for a road-toll system that combine the advantages of the known systems without adopting their respective disadvantages.

In a first aspect of the invention, a method of the type mentioned above includes the steps:

providing a set of location data of toll-requiring geo-objects from the respective local environment of a beacon in this beacon, recording a sequence of position data of a vehicle device in this vehicle device, if the aforementioned vehicle device is in the transmitting/receiving range of a beacon: receiving the location-data set from this beacon in the vehicle device, comparing the position-data sequence with the received location-data set in the vehicle device in order to generate toll information therefrom, and if the above-mentioned vehicle device is in the transmitting/receiving range of a beacon: transmitting the toll information from the vehicle device via the beacon to the toll center.

In a second aspect, the invention is a vehicle device of the type mentioned above that is distinguished by a second memory for holding at least one set of location data of toll-requiring geo-objects from the environment of a beacon, which location-data set is received by means of the short-range transceiver from this beacon, wherein the vehicle device compares the recorded position-data sequence with the received location-data set or sets in order to generate toll information therefrom, and transmits this toll information via the short-range transceiver to a beacon when the vehicle device is in its transmitting/receiving range.

In a third aspect of the invention, a beacon for such a road-toll system includes a short-range transceiver for radio communication with vehicle devices that are located in its transmitting/receiving range and is characterized by a memory for holding a set of location data of toll-requiring geo-objects from the environment of the beacon, with this beacon transmitting this location-data set to vehicle devices in its transmitting/receiving range.

In a fourth aspect, the invention is a monitoring device for a road-toll system with at least one such beacon, which device is constructed to detect movements of vehicle devices and which, based on the location-data set of a beacon and the detected movements of vehicle devices in the local environment of the beacon, checks the toll information generated by these vehicle devices—either directly in these vehicle devices or in a beacon. Incorrect or missing toll information can be recognized in this manner. In case of a negative checking result, further measures can preferably be initiated, in particular, photographic or video recording of the vehicle and/or recording and storage of data from the vehicle device.

BRIEF DESCRIPTION OF THE DRAWINGS

The invention will be described below in detail with reference to an embodiment illustrated in the appended drawings. In the drawings.

DETAILED DESCRIPTION

Figure 1:
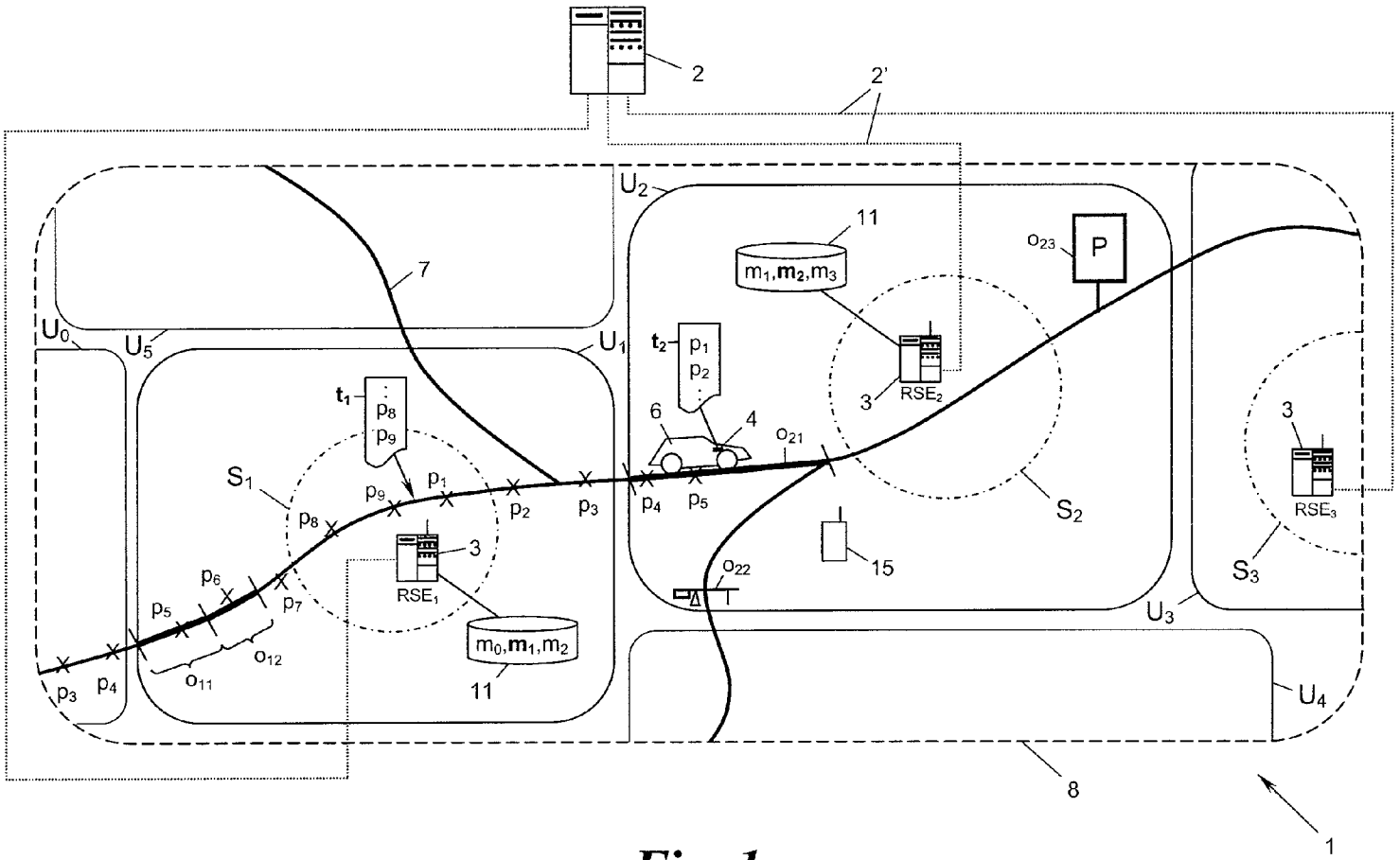
FIG. 1 shows a partial and schematic plan view of a road-toll system that operates according to some embodiments of the invention and comprises vehicle devices and beacons according to some embodiments of the invention.

The present invention is based on a novel use of self-location-finding OBUs within an infrastructure-bound toll system with radio beacons for distributing locally limited toll maps of the environment, so-called location-data sets, to passing OBUs and for receiving toll information calculated in the OBUs based on these local maps. Thereby the following advantages are achieved:

By subdividing the entire coverage area of the toll system into individual local sub-maps (location-data sets) the maintenance and provision of location data of the toll-requiring geo-objects to the OBUs is considerably simplified. In case of local changes, only the local location-data set must be updated in the center and/or the responsible beacons.

OBUs of the invention are constructed substantially more simply and economically in comparison with known "thick client" OBUs, since they only require small memories for holding the local toll maps of the area where they are located.

The data traffic necessary for distributing and updating the toll maps is also substantially reduced, which saves bandwidth. In addition, a mobile-radio network is not required for this, which saves the user considerable mobile-radio fees.

Finally the road infrastructure is also considerably simpler than for known infrastructure-bound systems: since the OBUs locate themselves, the location-finding precision is no longer dependent on the positions and density of the beacons, so that substantially fewer beacons are necessary. The beacons no longer need to have a directional characteristic—as in known DSRC systems—in order to locate passing OBUs as precisely as possible, but can instead be equipped with omnidirectional characteristics and can even service OBUs a considerable distance away, e.g., 1-2 km.

Not least of all, a beacon can thus be responsible not just for one, but for several toll-requiring geo-objects in its environs, whereby a very small number of beacons can be sufficient.

In some embodiments, the above-mentioned local environment of a beacon is larger than its transmitting/receiving range and provides the location-data set of an adjacent beacon in this beacon. Also, the location-data set of the adjacent beacon is received and compared with the position-data sequence. In this manner, the OBUs obtain current location-data sets along their route for the area in which they are located whenever they come into the transmitting/receiving range of a beacon, can process the most recently recorded position-data sequence based on these location-data sets into toll information and deliver the toll information generated in this way to a beacon along their route.

For the basic functions of the system according to the invention, it is sufficient if the OBUs are located in any manner known in the technology, for example, by means of radio direction finding in a mobile-radio network. In some embodiments, the position data is acquired and recorded with a satellite-navigation receiver of the vehicle device, as has been proven in practice for "thick client" OBUs for GNSS/CN toll systems.

The short-range radio communication between the vehicle devices and beacons can take place according to any short-range radio standard known in the art, but preferably according to the DSRC (dedicated short-range communication), WAVE (wireless access for vehicle environments) or WLAN (wireless local area network) standard, which allows the use of existing infrastructures.

In some embodiments, the location-data set additionally contains fee information that enters into the generation of the toll information. Thereby, for example, individual toll fees for individual toll-requiring geo-objects or special OBUs or OBU settings can be specified.

The location-data set can also comprise checking mechanisms such as checksums, hash functions or the like, with which its currentness, validity and/or completeness can be verified.

The generated toll information may be location-anonymized in order to guarantee data protection.

The memories of the vehicle unit of the invention may be ring buffers which hold only the most recently recorded position-data sequence(s) or the location-data set or sets most recently received, whereby memory space is saved and the vehicle device can be constructed correspondingly more inexpensively.

FIG. 1 shows a part of a road-toll system 1 with a toll center (central system, CS) 2 and a plurality of connected geographically distributed short-range radio beacons 3 ("beacons" for short) that are connected via connections 2'. The beacons 3, of which only three representative beacons $RSE_1$, $RSE_2$, $RSE_3$ (in general $RSE_1$) are shown, each have a processor and a transceiver of locally limited transmitting/receiving range $S_1$, $S_2$, $S_3$ ($S_i$ in general), inside of which they can communicate with vehicle devices or OBUs 4. For this purpose, the OBUs 4 are also equipped with corresponding short-range transceivers 5 (FIG. 2) for radio communication with the beacons 3. The short-range radio communication between the beacons 3 and the OBUs 4 preferably takes place according to the DSRC, WAVE or WLAN standard.

The OBUs 4 are carried by vehicles 6 that move on traffic areas 7, e.g., roads, freeways, parking lots, parking garages etc. of the coverage area 8 of the road-toll system 1.

The coverage area 8 of the road-toll system 1 is subdivided into a plurality of adjacent local environments $U_0$, $U_1$, $U_2$, $U_3$, $U_4$ ($U_i$ in general), to each of which one of the beacons 3 is assigned. The local environment $U_i$ of a beacon 3 is preferably larger than its transmitting/receiving range $S_i$. Geographical objects $o_{ij}$, so-called toll-requiring geo-objects, in the coverage area 8 of the road-toll system 1, wherein the usage of these objects by a vehicle 6 or, more precisely, its OBU 4 is to be charged ("tolled"), are distributed accordingly to the local environments $U_i$. Each beacon 3 is therefore responsible for charging tolls to the geo-objects $o_{ij}$ in its environment $U_i$.

The toll-requiring geo-objects $o_{ij}$ can be of any type. FIG. 1 shows some examples, such as street sections $o_{11}$, $o_{12}$ and $o_{21}$ that require tolls for traveling on them, a parking lot $o_{23}$ whose usage is subject to a fee and a barrier $o_{22}$ that requires a toll for passage.

Figure 2:
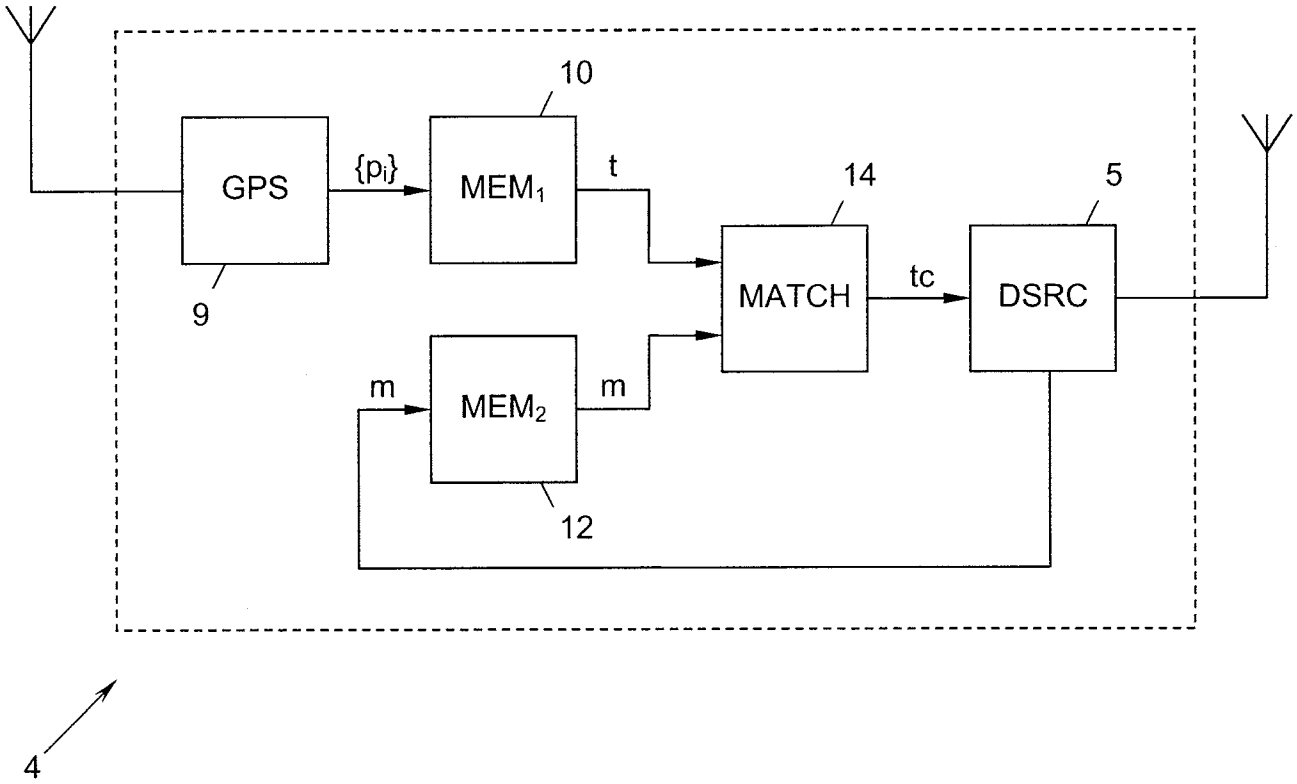
FIG. 2 shows a block schematic of a vehicle device according to some embodiments of the invention.

As shown in detail in FIG. 2, each OBU 4 is equipped with a device 9 for autonomous position finding. The device 9 is preferably a satellite-navigation system, e.g., a GPS receiver, that continually determines its position in a global satellite-navigation system and generates therefrom a sequence ("track") t of position data ("position fixes") $p_1$, $p_2$, . . . that is recorded in a first memory 10 of the OBU 4. The memory 10 is preferably a ring buffer that only contains the most recently acquired position data $p_i$.

Referring back to FIG. 1, each beacon 3 provides the location data of the geo-objects in its environment $U_i$ as a location-data set $m_i$ in a local memory 11 for passing OBUs 4. The location-data set $m_i$ is stored locally in the beacon 3 or is distributed centrally from the toll center 2 to the beacons 3 via the connections 2'. Each beacon 3 preferably also contains, in addition to its own location-data set $m_i$, the location-data sets of one or more adjacent environments $U_i$, in this case, for example, the location-data sets $m_1$ and $m_3$ of the adjacent environments $U_1$ and $U_3$ for the beacon $RSE_2$.

If an OBU 4 enters the transmitting/receiving range $S_i$ of a beacon 3, the beacon 3 transmits the location-data sets $m_i$ provided in its memory 11 to the OBU 4, which receives them via its transceiver 5 and stores them in a second memory 12. The second memory 12 is also preferably a ring buffer, which holds only the most recently received location-data sets $m_i$.

The OBU 4 then compares the position-data sequence t recorded in the memory 10 with the received location-data sets $m_i$ in the memory 12 for geographical similarity or association ("map matching," block 14), in order to generate toll information tc ("toll charges") therefrom.

The toll information tc generated in the OBU 4 is dispatched via the transceiver 5 to a beacon 3, specifically, either to the same beacon 3, if the OBU 4 is still in its transmitting/receiving range $S_i$, or to a subsequent beacon 3 whose transmitting/receiving range $S_i$ the OBU 4 enters on its way.

Fee information, such as geo-object-specific or OBU-specific or OBU-setting-specific toll fees, that was received from the beacons 3 together with the location-data sets $m_i$ is preferably also taken into account in the "map-matching" comparison 14.

Figure 3:
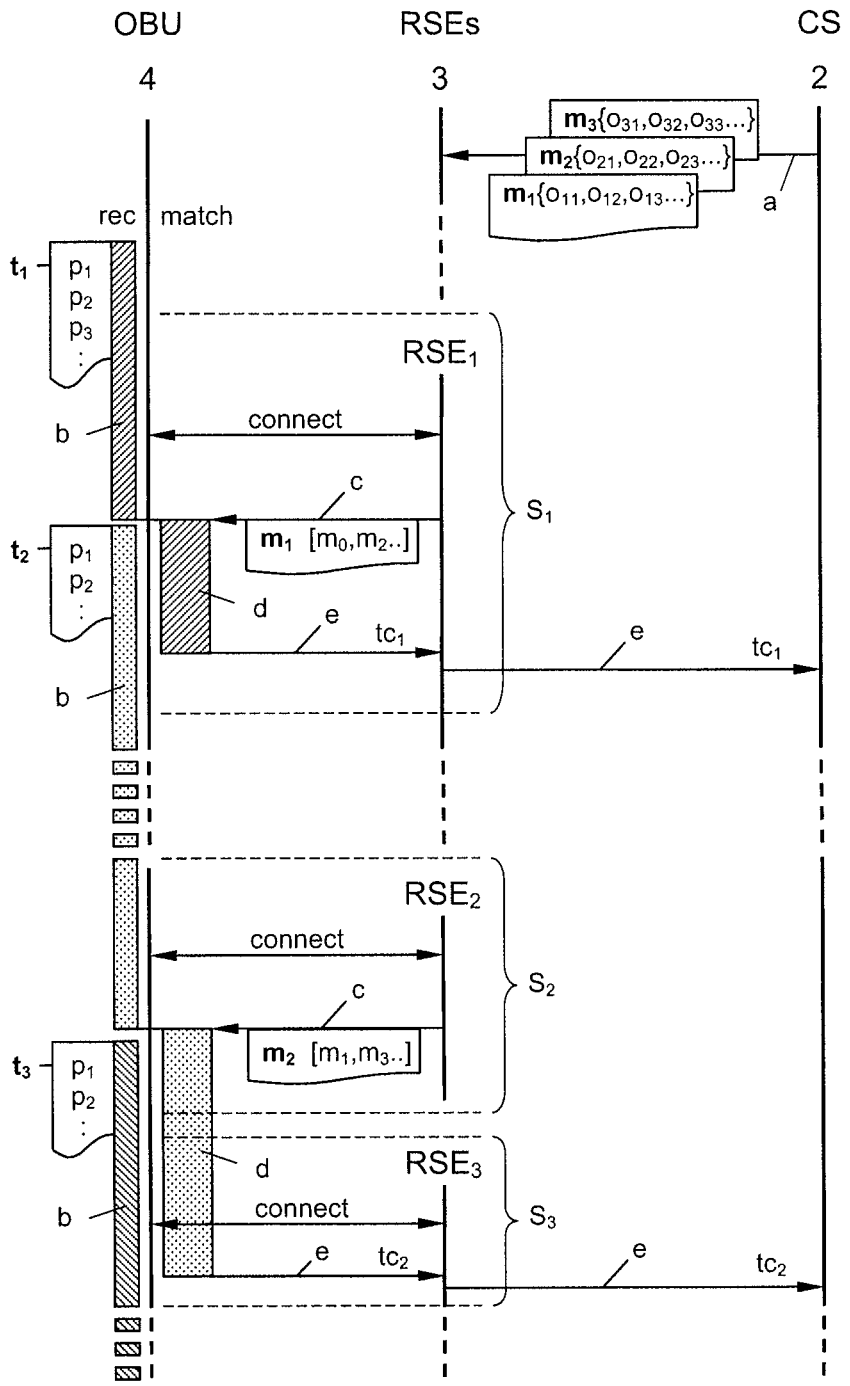
FIG. 3 shows a sequence diagram of a method, according to some embodiments of the invention.

FIG. 3 shows a sequence of the process once again in detail according to some embodiments of the invention. In a first step a), one or more sets $m_i$ with location data of toll-requiring geo-objects $o_{ij}$ of the respective environment $U_i$ of a beacon 3 are provided in the beacons 3, for example, by reception from the toll center 2 via the connections 2'.

In a step b), an OBU 4 records a first sequence $t_1$ of position data $\{p_1, p_2, p_3, \ldots\}$ in its memory 10. In a step c), as soon as the OBU 4 reaches the transmitting/receiving range $S_1$ of a first beacon 3, here $RSE_1$, it receives from the latter, after an appropriate handshake ("connect"), the location-data set $m_1$ of the beacon $RSE_1$ and optionally the location-data sets $m_0$, $m_2$ of the associated environments $U_0$, $U_2$.

In a subsequent step d), the OBU 4 performs a comparison between the recorded position-data sequence $t_1$ and the received location-data set or sets $m_0$, $m_1$, $m_2$ ("map matching"—block 14), optionally taking into account geo-object-specific and or OBU (setting)-specific fee information, which was received together with the location-data sets $m_i$, and generates toll information $tc_1$ therefrom. The toll information $tc_1$ is dispatched in a subsequent step e) via the transceiver 5 of the OBU 4, and via the closest available beacon 3, here still the beacon $RSE_1$, to the toll center 2.

After generation of the first toll information $tc_1$, the ring buffer 10 can be erased and it is possible to start again with the recording of the position data $p_i$ in order to record the next position-data sequence $t_2\{p_1, p_2, \ldots\}$.

As soon as the OBU 4 then reaches the transmitting/receiving range $S_2$ of a next beacon 3, here $RSE_2$, on its route, the steps c) and d) are performed again. As shown in FIG. 3, the generated second toll information $tc_2$ can be dispatched to the toll center 2 via one of the next beacons 3 on the route, here the beacon $RSE_3$, e.g., if the transmitting/receiving range $S_2$ of the second beacon $RSE_2$ has already been passed through during the step d).

The location-data sets $m_i$ of the beacons 3 can also be provided to (stationary or mobile) monitoring devices 15 of the road-toll system 1, preferably by direct transmission from the beacons 3 via the above-mentioned short-range radio communication The monitoring devices 15 are enabled in the conventional manner to detect or acquire the movements of vehicles 6 with vehicle devices 4 in their vicinity, for example, by means of photo or video monitoring, light barriers, radar or laser scanners, etc. The monitoring devices 15 check the toll information $tc_i$ generated by the vehicle devices 4, based on the location-data set or sets $m_i$ of a beacon 3 and the acquired vehicle movements in the environment $U_i$ of the beacon 3, and in the event of a divergence, e.g., a malfunction or a toll evasion, can then initiate further measures such as a photographic or video recording of the vehicle 6 and/or a registration and storage of data from the vehicle device 4.

If the toll system 1 also comprises "thin client" OBUs, which transmit their position-data sequences $t_i$ directly to a beacon 3, so that the latter can generate the toll information $tc_i$ based on their location-data sets $m_i$, the monitoring devices 15 could also be used to check the toll information $tc_i$ generated by this beacon 3, based on the location-data sets $m_i$ received by a beacon and the detected movements of the OBUs in the local environment $U_i$ of a beacon.

The invention is not limited to the illustrated embodiments, but rather comprises all variants and modifications that fall within the scope of the appended claims.

The invention claimed is:

1. A method for generating toll information from movements of vehicle devices in a road-toll system that comprises at least one toll center and a plurality of connected, geographically distributed beacons for short-range radio communication with the vehicle devices, the method comprising:

providing, in a memory of a first beacon of the geographically distributed beacons, a first set of location data of one or more stationary toll-requiring geo-objects, other than the first beacon, in a local environment of said first beacon;

providing, in the memory of the first beacon, a second location data set of one or more stationary toll-requiring geo-objects in a local environment of a second beacon of the geographically distributed beacons, the second location data set also stored in a memory of the second beacon and being different from the first location data set;

recording, in a vehicle device, a sequence of position data of said vehicle device;

when said vehicle device is in the transmitting/receiving range of said first beacon, receiving the first and second location-data sets from said first beacon in the vehicle device;

comparing the position-data sequence with the received location-data sets in the vehicle device for geographical similarity to generate toll information therefrom; and when said vehicle device is in the transmitting/receiving range of the first beacon or the second beacon, transmitting the toll information from the vehicle device via the first beacon or the second beacon to the toll center.

2. The method according to claim 1, wherein said local environment of the first beacon is larger than its transmitting/receiving range.

3. The method according to claim 1, wherein the position data is acquired and recorded with a satellite-navigation receiver of the vehicle device.

4. The method according to claim 1, wherein the short-range radio communication between vehicle device and the first beacon takes place according to the DSRC, WAVE or WLAN standard.

5. The method according to claim 1, wherein the first location data set further includes fee information utilized for generation of the toll information.

6. The method according to claim 1, wherein the first location-data set further includes checksums or hash functions to verify its currentness, validity or completeness.

7. The method according to claim 1, wherein the generated toll information is location-anonymized.

8. A vehicle device for a road toll system comprising:

a satellite-navigation receiver for generating a sequence of position data;

a first memory for storing the position-data sequence;

a short-range transceiver for radio communication with a first beacon of a plurality of geographically distributed beacons when the vehicle device is in the transmitting/receiving range of said first beacon; and a second memory for holding at least two location data sets of one or more stationary toll-requiring geo-objects, other than the first beacon, in the environments of the first beacon and one or more adjacent beacons, the at least two location data sets including a first location data set of one or more stationary toll-requiring geo-objects, other than the first beacon, in a local environment of the first beacon, and including a second location data set of one or more stationary toll-requiring geo-objects in a local environment of a second beacon;

wherein one or more of said at least two location data sets is received by the short-range transceiver from said first beacon, wherein the vehicle device is configured to:

compare the stored position-data sequence with the received one or more of said at least two location data sets of said one or more stationary toll-requiring geo-objects for geographical similarity to generate toll information therefrom, and to transmit said toll information via the short-range transceiver to said first beacon or the second beacon when the vehicle device is in the transmitting/receiving range of said first beacon or the second beacon.

9. The vehicle device according to claim 8, wherein the second memory is a ring buffer, which holds only the most recently received location-data set or sets.

10. The vehicle device according to claim 8, wherein the second memory holds fee information received with the at least two location-data sets, which is utilized by the vehicle device to generate the toll information.

11. The vehicle device according to claim 8, wherein the short-range transceiver is one or more of the group consisting of a DSRC, WAVE and WLAN transceiver.

* * * * *